US007644807B2

(12) United States Patent
Finkbeiner

(10) Patent No.: US 7,644,807 B2
(45) Date of Patent: Jan. 12, 2010

(54) METHOD FOR DETECTING A CONFIGURATION OF A PLURALITY OF LIFTING DEVICES IN A LIFTING SYSTEM

(75) Inventor: Gerhard Finkbeiner, Freudenstadt (DE)

(73) Assignee: Walter Finkbeiner GmbH, Freudenstadt (DE)

( * ) Notice: Subject to any disclaimer, the term of this patent is extended or adjusted under 35 U.S.C. 154(b) by 623 days.

(21) Appl. No.: 11/545,792

(22) Filed: Oct. 10, 2006

(65) Prior Publication Data

US 2007/0096068 A1 May 3, 2007

(30) Foreign Application Priority Data

Oct. 11, 2005 (DE) ..... 10 2005 049 002

(51) Int. Cl.
*B66B 1/00* (2006.01)

(52) U.S. Cl. ..... 187/277; 187/224

(58) Field of Classification Search ..... 187/203, 187/207, 210, 213, 226, 227, 233, 247, 248, 187/250, 276, 277, 413, 224; 254/11, 12, 254/45, 47, 419, 424, 273, 275, 290, 292; 414/564, 610, 613, 628; 60/428, 327, 328, 60/343, 370, 354, 350; 91/1, 171, 362; 182/18, 182/128, 131, 132, 141, 143, 144, 147
See application file for complete search history.

(56) References Cited

U.S. PATENT DOCUMENTS

| | | | | |
|---|---|---|---|---|
| 3,968,730 | A * | 7/1976 | Lionet | 91/171 |
| 4,777,798 | A * | 10/1988 | Jacobson et al. | 60/428 |
| 5,199,686 | A * | 4/1993 | Fletcher | 187/211 |
| 6,318,508 | B1 * | 11/2001 | Inoue | 187/394 |
| 6,763,916 | B2 * | 7/2004 | Green et al. | 187/277 |
| 6,964,322 | B2 * | 11/2005 | Green et al. | 187/285 |
| 7,014,012 | B2 * | 3/2006 | Baker | 187/247 |
| 7,025,178 | B2 * | 4/2006 | Wengelski et al. | 187/277 |
| 7,208,896 | B2 * | 4/2007 | Ford et al. | 318/433 |

FOREIGN PATENT DOCUMENTS

EP 1285878 A1 2/2003

* cited by examiner

*Primary Examiner*—Jonathan Salata
(74) *Attorney, Agent, or Firm*—Kriegsman & Kriegsman

(57) ABSTRACT

The invention relates to a method for detecting a configuration of a plurality of lifting devices (12, 13) in a lifting system (11), wherein a lifting device (12, 13) is defined as a master lifting device with the node address 1, wherein subsequently a node address n+1 is generated and stored for the subsequent lifting device (12*b*, 13*b*) so that the number and assignment of the lifting devices (12, 13) will be detected.

9 Claims, 2 Drawing Sheets

METHOD FOR DETECTING A CONFIGURATION OF A PLURALITY OF LIFTING DEVICES IN A LIFTING SYSTEM

This invention relates to a method for detecting a configuration of a plurality of lifting devices in a lifting system.

From EP 1 285 878 A1, a lifting system has been known which comprises at least two lifting devices consisting of a baseframe and a lifting unit. The lifting unit comprises a lifting cylinder to move a load carrying device up and down for lifting and lowering the load. The lifting devices are connected with supply lines so that joint control will be enabled.

It has been known until now that the lifting devices are coded. However, when setting up these lifting devices, it is necessary that a sequence of the lifting devices will be complied with which is specified by the coding. This requires special attention in setting up a plurality of lifting devices. Moreover, an optional arrangement of the lifting devices to form a lifting system is not rendered possible.

Accordingly, the invention is based on the object of providing a method for detecting a configuration of a plurality of lifting devices in a lifting system by means of which the lifting devices—prior to lifting and lowering a load within the lifting system—will obtain a unique assignment to each other, and the number of lifting devices tied into the lifting system will be detected.

This problem is solved in accordance with the invention by a method according to the features of claim 1. Further advantageous embodiments are specified in the other dependent claims.

The method according to the invention renders it possible that any arbitrary number of lifting devices will be configured to form a lifting system. This means that a first lifting device will be initialized as the master lifting device, and the subsequent lifting devices will be controlled via this master lifting device and obtain a node address based on the master lifting device. This successive initialization of the other lifting devices arranged in series to the master lifting device and their assignment to a node address will be continued until the last lifting device has been reached. Based on an initialization there provided which signals an open end of the lifting devices arranged in series, the master lifting device will receive a signal that all lifting devices located in between were successively initialized so that the method of configuration is concluded.

This method provides the advantage that non-coded lifting devices can be used and, depending on the case of application, the required number of lifting devices can be arbitrarily assigned to the working space for lifting and lowering the load, without a specific sequence to be maintained. At the same time, the number of lifting devices integrated in the lifting system will be detected through the initialization of the node addresses. Due to this method, the other lifting devices in the lifting system can be specifically controlled through the one master lifting device because of its assignment of a node address. At the same time, it is rendered possible that—upon the occurrence of an error on the master lifting device or on any other lifting device—an error message will be issued, and the user will be shown which lifting device is concerned.

According to an advantageous embodiment of the method, it is provided that the lifting devices connected with supply lines are set up in an open U-form, and the first and the last lifting device will form a lifting pair at the open end, the second and the second to last lifting device form a lifting pair, etc. This will facilitate the control when multi-axle vehicles are lifted and lowered. It is advantageous, for example, for a tractor trailer to lift only one lifting pair—the trailer, for example—while the other axles of the tractor are not lifted or only slightly by the correspondingly assigned lifting pairs.

Due to the assignment of the node address to each lifting device, a paired assignment of the opposite lifting devices will be preferably enabled. It is preferably provided that at least one lifting pair is controlled for the lifting movement. The flexibility in application of the lifting devices will thus be increased.

According to a preferred embodiment of the method, it is alternatively provided that a single travel of a lifting device is controlled by a master lifting device. A user-defined individual selection can thus be provided for the control of lifting devices. Such control will increase the flexibility of the system.

The lifting device intended as the master lifting device will be preferably connected with an energy supply to a network or to an autonomous source of energy, and at the input of the control of the master lifting device, an input level will be set or simulated. After connecting the lifting devices via the supply line and their initialization, the configuration will thus be started by the master lifting device addressing itself as such through the simulated input level to subsequently initiate further configuration steps.

Moreover, it is preferably provided that at least one lifting device without an energy supply connection is connected in series between two lifting devices with an energy supply connection. The supply points can thus be reduced. At the same time, it can be ensured that an adequate energy supply for the lifting and lowering action will be provided.

According to another advantageous embodiment of the method, it is provided that a lifting system is formed of lifting devices each having their own energy supply. Thus, the supply points can be selected any optional way at all. Moreover, uniformity of the lifting devices is given so that their arrangement is provided in any optional way to form a lifting system.

According to another advantageous embodiment of the method, it is provided that the current configuration of the lifting devices is shown on the display of at least one control. Thus, the lifting devices present in the lifting system will be shown in a visualized form. It is accordingly possible to check whether the number of lifting devices shown in the display is equivalent to the number of lifting devices present in the system.

Moreover, it is preferably provided that the activated and non-activated lifting devices are shown in the display. This can be such, for example, that a first pair of lifting devices which is activated will be provided with a capital letter; whereas another pair of lifting devices which is not activated will be shown with a lower case letter. Alternatively, a color background or highlighting can also be provided. The display is preferably provided on the master lifting device. Alternatively, a display can also be provided on every lifting device, with the current configuration being shown in every display of the lifting device—after configuration of the lifting devices and addressing.

In the following, the invention as well as additional advantageous embodiments and developments of the same will be explained and described in detail on the basis of the examples presented in the drawings. The features which can be gathered from the description and the drawings can be used individually by themselves or in a plurality in any combination according to the invention. In the Figures, FIG. 1 is a perspective representation of a lifting system;

Figure 1:
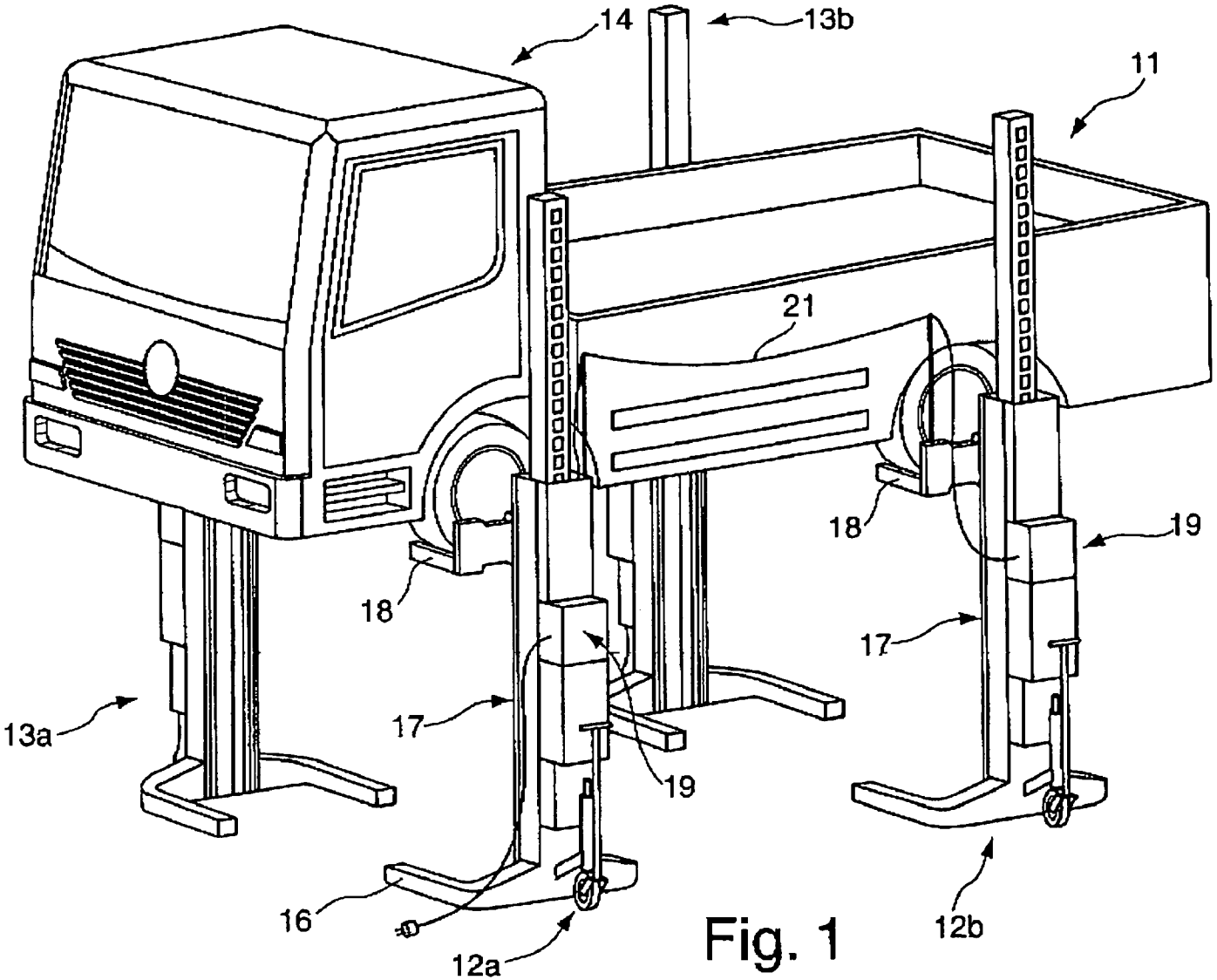

FIG. 1 presents a lifting system 11 comprising, for example, four lifting devices 12*a*, 12*b*, 13*a*, 13*b* which lift a load. This load 14 is a vehicle, for example; in particular, a passenger car, a truck, a utility vehicle, a tank, or a rail car. The lifting device 12 comprises a baseframe 16 and a lifting unit 17 which move a load carrying device 18 up and down for lifting and lowering. In the exemplary embodiment, the load carrying device 18 is designed as a wheel gripper to act on a wheel of the vehicle or, respectively, to single flange on the wheel. The lifting devices 12, 13 are connected with each other by supply lines 21 which comprise an energy supply as well as control and/or information lines. These supply lines 21 are connected to controls 19 of the lifting devices 12.

The lifting devices 12 are connected in series by the supply lines 21, that means the sequence of the lifting devices 12*a*, 12*b*, 13*b*, 13*a* is determined by the supply lines 21. An open end is formed between the lifting devices 12*a* and 13*a* so that the load 14 can be introduced, via this open end, into a working space which is provided between the lifting devices 12*a*, 12*b*, 13*a*, 13*b* or circumscribed by them, respectively.

Figure 2:
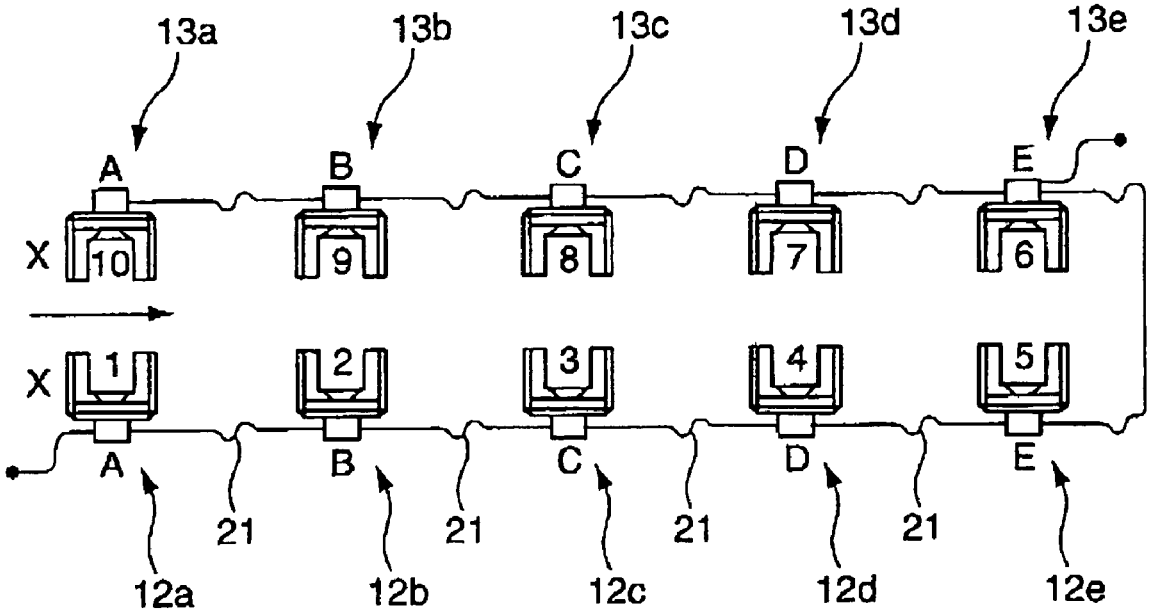
FIG. 2 shows a diagrammatic top view of an alternative configuration of a lifting system with a plurality of lifting devices.

FIG. 2 provides a diagrammatic view of a plurality of lifting devices arranged in pairs—12*a* to *e* and 13*a* to *e*—which are series connected with each other by connecting lines 21. Such an arrangement is provided, for example, for a five-axle vehicle. The setup is analog to a two-axle vehicle according to FIG. 1.

The number of the lifting devices 12, 13 to be connected with each other to form a lifting system 11 depends on the load to be lifted so that for monitoring the lifting system 11, it will be necessary that the individual lifting devices 12, 13 are detected by the control 19 or a separately arranged overall control and its position within the lifting system 11 is known.

The method according to the invention for detecting a configuration of a plurality of lifting devices 12, 13 in a lifting system 11 enables simple and user-friendly handling so that the arrangement and positioning of the individual lifting devices 12, 13 will be simplified and a specific sequence for the lifting devices 12, 13 arranged in succession will not be necessary, said handling being presented below:

The lifting devices 12, 13 are positioned according to the load 14 to be lifted. Thereafter, the supply lines 21 are provided between the lifting devices 12, 13 to connect or link the lifting devices 12, 13 in series with each other. Subsequently, voltage is applied to the lifting device 12*a* provided at an open end. The corresponding controls 19 of the lifting devices 12, 13 ramp up, and initialization of the control 19 will be provided by a control or, respectively, bus line in the connecting lines 21. Subsequently, an input level is detected on a first lifting device 12*a* which is realized, for example, by a bridge in the wiring. This lifting device 12*a* is thus defined with a node address 1 as the master lifting device so that the other series connected lifting devices 12, 13 depend on this first lifting device 12*a*. Due to the self-determination of the first lifting device 12*a* as the master lifting device, it will take over the control for the other lifting devices 12, 13 as well as the assignment to the master lifting device. After the master lifting device has defined itself, an output of the master lifting device will be switched so that a level applies at the input of the subsequent lifting device 12*b* and a node address n+1 is generated since the node address 1 is already occupied by the master lifting device. After generation of the node address 2 for the lifting device 12*b*, the control 19 enables an output of the control 19 on the lifting device 12*b* so that an input level in turn applies on the subsequent lifting device 13*b* according to FIG. 1 or the lifting device 12*c* according to FIG. 2. A new node address will be generated and, subsequently, the output of the control 19 of lifting device 13*b* or 12*c* is again enabled so that, one after the other, the lifting devices 12, 13—connected with the connecting lines 21—will be provided with a unique assignment of node addresses. By means of a bus controller which connects the individual lifting devices 12, 13 with each other, each control 19 of the lifting device 12, 13 will recognize which node address forms the lifting device 12, 13 itself and which number of lifting devices 12, 13 forms the lifting system 11.

The end of the assignment of node addresses is detected by the last lifting device 13*a* arranged at the open end. Through another input level, the last lifting device 13*a* detects that no more subsequent lifting device 12, 13 will be provided in the system and issues a signal to the master lifting device, and the method for detecting the configuration of lifting devices 12, 13 in the lifting system 11 will be terminated.

In the aforementioned method, all lifting devices 12, 13 are designed the same. Alternatively, two types of lifting devices 12, 13 can be provided. One type of lifting devices 12, 13 already comprises an energy supply line, and the other type of lifting devices is designed without an energy supply line. The lifting devices 12, 13 designed with the energy supply line will be positioned at the beginning of a series of lifting devices 12, 13 and initialized as the master lifting device. The other lifting devices 12, 13 are so-called slave lifting devices. The lifting devices provided with energy supply lines which are not initialized as a master lifting device can be used as slave lifting devices, with the advantage that the energy supply can be provided through them according to a predetermined number of slave lifting devices.

After the complete generation of node addresses for the corresponding lifting devices 12, 13, the lifting devices 12, 13 facing each other will be assigned in pairs to each other so that, for lifting and lowering, paired control of the lifting devices 12*a* and 13*a*, 12*b* and 13*b* will be enabled. At the same time, the control enables one pair or a plurality of pairs to be selected which will simultaneously perform the lifting and lowering action.

This method for detecting a configuration of a lifting system 11 furthermore renders it possible that—from every control 19 of the lifting device 12, 13—the overall system or individual lifting devices 12, 13 are controllable, and that the pair control or group control of the lifting devices 12, 13 will also be enabled.

Additionally, in case of an error occurring, each control 19 can issue an error message and indicate which of the lifting devices 12, 13 has issued the error message. Thus, a flexible lifting system 11 is created which is user-friendly in its setup and provides, at the same time, a high degree of monitoring and thus safety in the operation of the lifting system 11.

Figure 3:
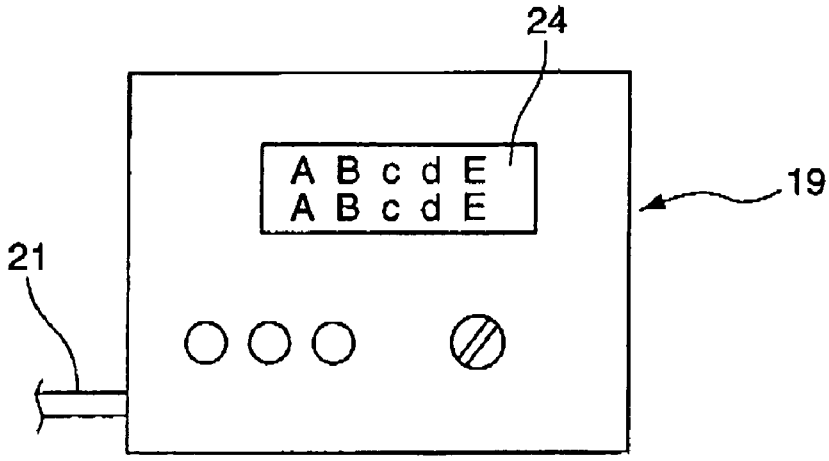
FIG. 3 shows a diagrammatic view of a display of a lifting device.

FIG. 3 shows a schematic display 24 of a control 19. After configuration of the lifting system 11, symbols appear on the display 23, which not only indicates the number of the lifting devices 12, 13 provided in the lifting system 11 but also signals the assignment in pairs. For example, a first lifting pair is assigned the letter A; a second lifting pair the letter B, etc. The display of a capital letter will signal that this lifting device 12, 13 or, respectively, the lifting pair A is activated. A display in the form of a lower case letter shows that these lifting devices 12, 13 are not activated—as, for example, the lifting pair c and d. Alternatively, different symbols can be provided for this identification. A combination of two symbols or a color presentation will also be possible to show not only the assignment in pairs but also the activation or, respectively, non-activation of the lifting devices 12, 13. Additionally, in case of an error message, a text for the error message can appear directly, or the individual lifting device 12, 13 which is identified by a letter, for example, can be highlighted in a specific color and/or the letter be changed in color.

All of the above described features are each on their own essential for the invention and can be combined with each other in any way.

The invention clamed is:

1. Method for detecting a configuration of a plurality of lifting devices in a lifting system, wherein a plurality of lifting devices is selected for lifting a load and connected in series with each other by supply lines;

wherein controls of the lifting devices in the lifting system are initialized by a control line;

wherein a level is simulated and a first node address is generated and stored at the input of the control with a lifting device which is positioned at the open end of the series so that this lifting device is defined as the master lifting device with the node address 1;

wherein an output of the control of the first lifting device is subsequently switched and the level applies on an input of a subsequent lifting device, and a node address n+1 on the subsequent lifting device will be generated and stored;

wherein the preceding step for the generation of the node address n+1 and enabling an output of the control will be repeatedly executed until another level is applied to the last lifting device intended in the series to signalize the end of the series, and a signal is provided to the first lifting device so that the node addresses assigned to the corresponding lifting devices will be stored.

2. Method according to claim 1, characterized in that the lifting devices are set up in U-form, and the first and the last lifting device, the second and the second to last lifting device are assigned to each other to form a lifting pair.

3. Method according to claim 2, characterized in that at least one lifting pair is controlled for a lifting action.

4. Method according to claim 1, characterized in that an individual travel of a lifting device is controlled by a master lifting device.

5. Method according to claim 1, characterized in that a lifting device is provided with an energy supply connection to the network or an autonomous energy source and used as master lifting device, and an input level is simulated at the input of the control of the master lifting device.

6. Method according to claim 5, characterized in that the input level is simulated by a bridge in the wiring.

7. Method according to claim 1, characterized in that at least two lifting devices without an energy supply connection are switched in series between two lifting devices with an energy supply connection.

8. Method according to claim 1, characterized in that a lifting system is formed of lifting devices each having their own energy supply.

9. Method according to claim 1, characterized in that the current configuration of the lifting devices is shown on a display of a control.

* * * * *